US006842944B2

(12) United States Patent
Maurer

(10) Patent No.: US 6,842,944 B2
(45) Date of Patent: Jan. 18, 2005

(54) FOUR PIVOT SWING AWAY HINGE

(76) Inventor: Scott D. Maurer, 16 Hidden Valley, Rocky River, OH (US) 44116

( * ) Notice: Subject to any disclaimer, the term of this patent is extended or adjusted under 35 U.S.C. 154(b) by 0 days.

(21) Appl. No.: 10/218,356

(22) Filed: Aug. 14, 2002

(65) Prior Publication Data

US 2004/0031126 A1 Feb. 19, 2004

(51) Int. Cl.[7] ..... E05D 15/32
(52) U.S. Cl. ..... 16/366; 16/368; 16/370
(58) Field of Search ..... 16/365–366, 368–370

(56) References Cited

U.S. PATENT DOCUMENTS

| | | | | |
|---|---|---|---|---|
| 1,078,786 A | | 11/1913 | Hanba et al. | |
| 1,593,930 A | | 7/1926 | Carrier | |
| 1,817,113 A | * | 8/1931 | Sipe | 270/39.05 |
| 1,984,092 A | * | 12/1934 | Soss | 16/369 |
| 2,135,280 A | * | 11/1938 | Erickson | 16/369 |
| 2,564,988 A | | 8/1951 | Muller | |
| 2,686,332 A | * | 8/1954 | Tull et al. | 16/369 |
| 2,779,069 A | * | 1/1957 | Ziesmer | 16/370 |
| 2,882,004 A | * | 4/1959 | Leishman | 16/366 |
| 2,901,766 A | | 9/1959 | Marquis | |
| 4,499,631 A | | 2/1985 | Lautenschläager | |
| 4,703,540 A | * | 11/1987 | Davis | 16/337 |
| 4,756,054 A | * | 7/1988 | Mitts et al. | 16/237 |
| 4,848,244 A | * | 7/1989 | Bennett | 16/370 |
| 4,873,743 A | | 10/1989 | Toyama | |
| 5,450,654 A | | 9/1995 | Sullivan | |
| 5,491,875 A | | 2/1996 | Siladke et al. | |
| 6,175,991 B1 | | 1/2001 | Driesman et al. | |
| 6,212,827 B1 | * | 4/2001 | Miller | 16/366 |

FOREIGN PATENT DOCUMENTS

| | | | | |
|---|---|---|---|---|
| DE | 43 08 675 A1 | | 9/1994 | |
| EP | 0 402 235 A1 | | 12/1990 | |
| EP | 565900 A1 | * | 10/1993 | E05D/3/06 |
| SU | 1680917 A1 | | 9/1991 | |

* cited by examiner

*Primary Examiner*—Daniel P. Stodola
*Assistant Examiner*—Christopher Boswell
(74) *Attorney, Agent, or Firm*—Hahn Loeser & Parks, LLP; Robert J. Clark

(57) ABSTRACT

An improved swing away style door hinge utilizing at least four hinge members attached to each other about four pivot points. The new hinge allows greater access through a doorway wherein the door is positioned outside of the doorway clearance space when the door is opened 90 degrees. The hinge may also limit the opening movement of the door. The hinge is an aesthetically pleasing hinge with a relatively small footprint compared to other swing away style hinges.

30 Claims, 11 Drawing Sheets

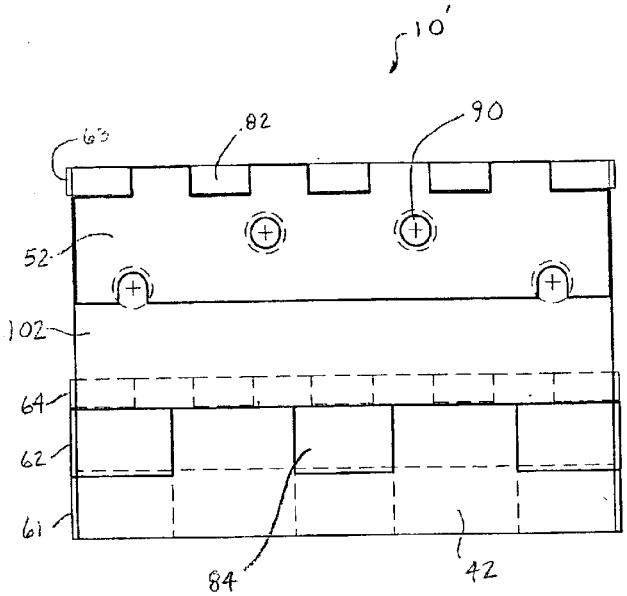
FIG. 5B
FIG. 5A
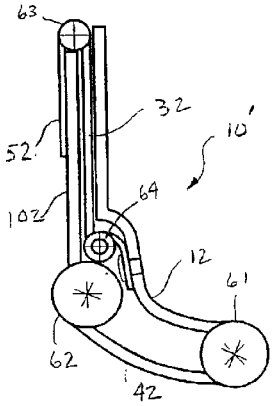
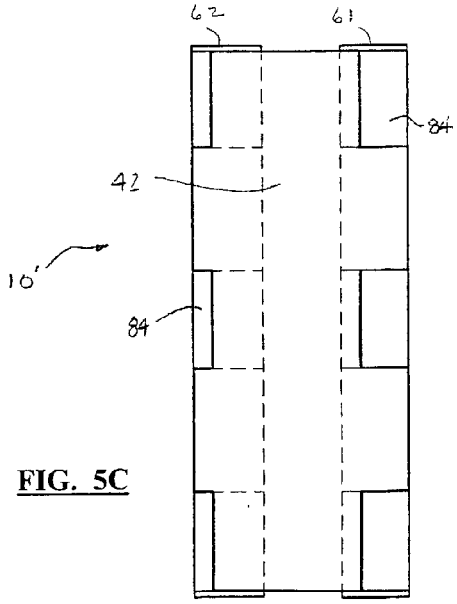
FIG. 5C

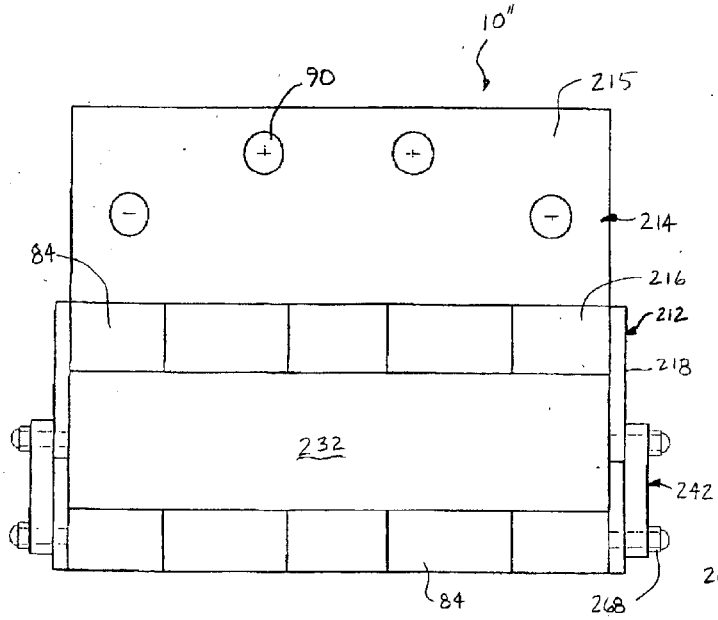
FIG. 9B
FIG. 9A
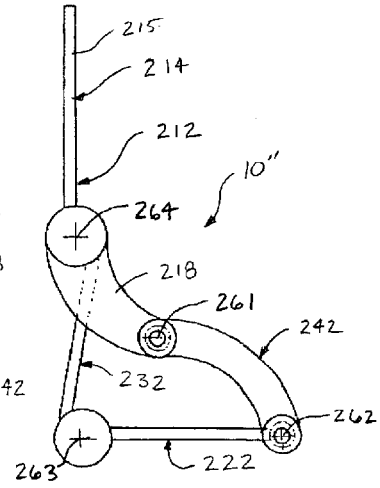
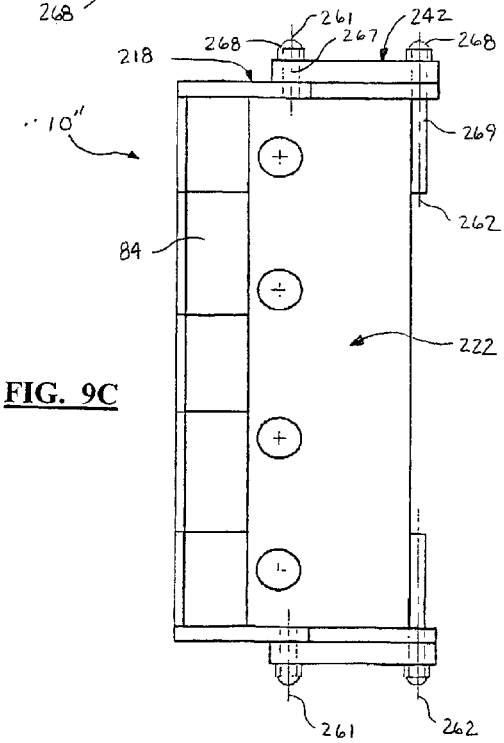
FIG. 9C

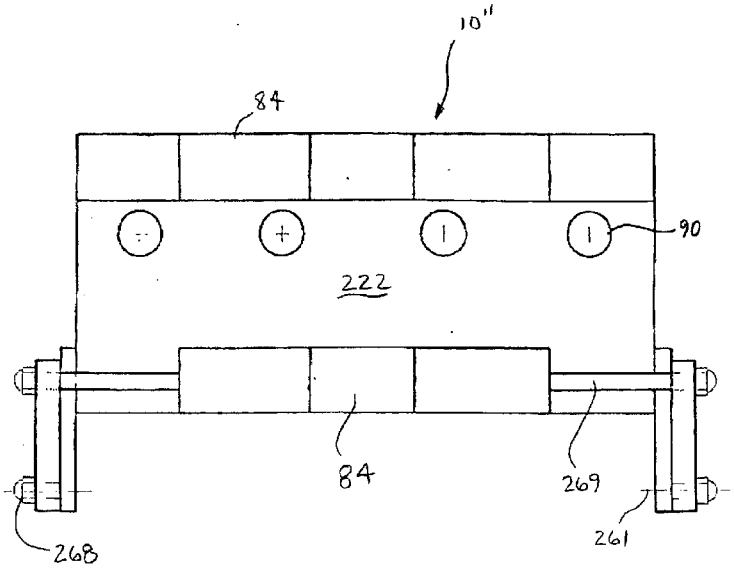
FIG. 10B
FIG. 10A
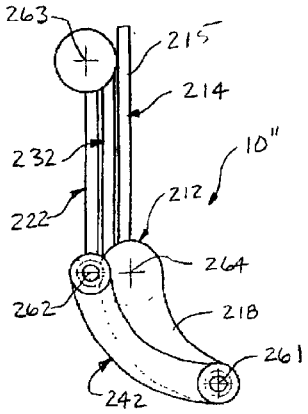
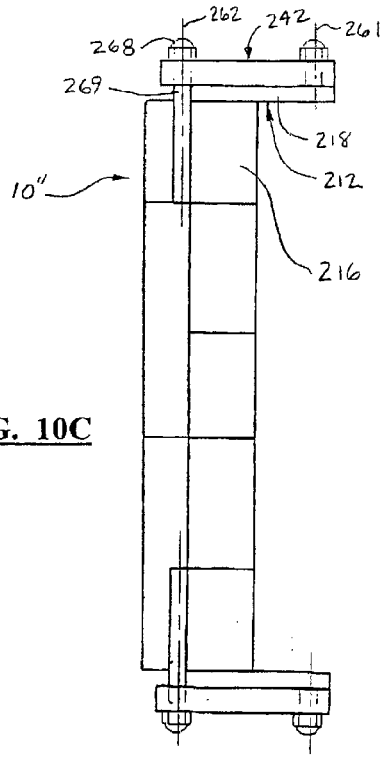
FIG. 10C

FOUR PIVOT SWING AWAY HINGE

FIELD OF THE INVENTION

The present invention relates generally to hinges and more particularly, to an articulated, four pivot, swing away hinge which allows greater access through a doorway and is an aesthetically pleasing hinge. The present invention also relates to concurrently filed patent applications by the same inventor, application Ser. No. 60/403,350 entitled GEARED SWING AWAY HINGE and application Ser. No. 10/218,355 entitled ARTICULATED SWING AWAY HINGE, both herein incorporated by reference.

BACKGROUND OF THE INVENTION

The most common standard door hinge is a butt hinge which comprises two plates or leaves hingedly attached to each other about a single pivot point or axis. A typical prior art butt hinge 100 is shown in FIG. 1A and comprises a door side leaf 102 and a jamb side leaf 104. The door side leaf 102 is typically mortised into a heel or edge 110 of the door 106 and the jamb side leaf 104 is typically mortised into jamb 108 of the doorway. Each of the leaves 102, 104 are further provided with a plurality of apertures (not shown) for passage of screws therethrough in order to attach the door side leaf 102 to the door heel or edge 110 and the jamb side leaf 104 to the door jamb 108. The leaves 102, 104 each have one or more rolled, tubular segments or knuckles (not shown) along a side edge. The knuckles of each leaf 102, 104 are specifically sized and arranged so as to mesh in axial alignment with the knuckles of the other leaf, thereby forming a hinge bone. A pin 112 is inserted through the axially aligned knuckles to effectively couple the leaves 102, 104 so that they are movable relative to one another about a common axis, defined by the hinge pin 112.

A problem with the standard butt hinge 100 is that when the door 106 is open at a 90 degree angle as shown in FIG. 1A, the entire door 106 is in the doorway thereby cutting down the available width or access through the doorway clearance space. The doorway clearance space 107 is generally defined as the space between two parallel planes 109, wherein each plane 109 is co-planar to a corresponding front face 111 of a door stop 113 on either side of the doorway as best shown in FIG. 1B. The problem is further accentuated by the fact that it is preferred in architectural design to place doorways near a corner of the room in order to cut down on lost room/wall available space, promote airflow in the structure, etc., as shown in FIG. 1B. The result is that the hinge side of the doorway may have a wall 130 perpendicular to the doorway wall 128 which limits the door movement to significantly less than the 180 degrees needed to clear the door 106 from the doorway clearance space 108. This requires that the door 106 is removed from the doorway by disconnecting all the hinges 100 any time furniture or other larger objects are needed to be moved through the doorway. Another resulting problem is that the standard butt hinge 100 allows the door to swing freely regardless if there is a wall in the path of the door 106. In order to prevent the door handle from damaging a perpendicular wall 130, a door stop must be added to the wall 130 or to the door hinge 100 to limit the movement of the door 106. Door stops are generally not aesthetically pleasing, may damage the door, add cost to procure and install, and may present a hazard protruding from the wall when the door is closed.

One attempt to solve the door clearance problem is the swing away or offset hinge. The offset hinge also comprises two leaves in the form of brackets hingedly attached to each other about a single pivot point such that the brackets nest in each other when the door is closed. As shown in FIG. 2, the offset hinge 120 has a pivot point formed by the hinge pin 112 which is significantly offset away from the door jamb 108. When the door is opened at 90 degrees, the door is no longer in the doorway clearance space 108. However, several problems with the offset hinge 120 have prevented the use of the offset hinge 120 in most applications other than hospitals and other functional based environments. The offset hinge 120 is not aesthetically pleasing. The bracket leaves 122, 124 must extend completely over the casing of the doorway in order to enable the door to swing out of the passageway. The operation of the brackets 122, 124 place the door 106 at a significant distance from the doorway when the door 106 is opened at 90 degrees. This results in large moment, compressive, and tensile forces acting on the hinges 120 due to the weight and position of the door 106. This requires that the brackets 122, 124 are oversized to compensate for the strength requirement, or that additional hinges 120 are used to mount the door 106. Reinforcement of the wall may be required to support the hinge and door. In addition, the entire surface of both bracket leaves 122, 124 are visible when the door is opened making the offset hinge 120 even more aesthetically unpleasing and is a potential hazard to children. Another problem with the offset hinge 120 is that, like the standard butt hinge 100, the door 106 is able to swing freely regardless if there is a wall in the path of the door 106. Accordingly, a door stop must be added to the wall or to the offset hinge 120 to limit the movement of the door 106.

In view of the above noted problems as well as other problems associated with prior art hinges, there remains a need in the art for an aesthetically pleasing hinge assembly which moves the door out of the doorway when the door is opened at a 90 degree angle.

SUMMARY OF THE INVENTION

It is an object of the invention to provide an improved hinge utilizing a plurality of hinged pivot points which overcomes at least one deficiency in the prior art. These and other advantages are provided by a hinge for attachment of a door to a door jamb of a doorway, the doorway having a clearance space defined by the space between two parallel planes, each plane tangent to a corresponding front face of a door stop on either side of the doorway, the hinge comprising: a first hinge member fixably attached to the door jamb; a second hinge member fixably attached to the door; a third hinge member having a first end hingedly attached to the first hinge member at a first hinge point and a second end hingedly attached to the second hinge member at a second hinge point; wherein the second hinge point is rotatable about the first hinge point; and a means for controlling the position of the second hinge member with respect to the first hinge member; wherein the door is positioned outside of the doorway clearance space when the door is opened 90 degrees.

These and other advantages are also provided by a hinge comprising a first hinge member having a first generally planar end portion having a plurality of attachment holes, a second end portion, and an intermediate portion between the first end portion and the second end portion; a second hinge member having a first end, a second end, and plurality of attachment holes formed between the first end and the second end; a third hinge member having a first end hingedly attached to the first end of the second hinge member and a second end hingedly attached to the intermediate portion of the first hinge member; and a fourth hinge member having a first end hingedly attached to the second end of the first hinge member and a second end hingedly attached to the second end of the second hinge member; wherein the hinge is movable from a closed position wherein the second hinge member and the first end portion of the first hinge member are generally parallel to each other to at least an open position wherein the second hinge member and the first end portion of the first hinge member are generally perpendicular to each other.

These and other advantages of the present invention will be apparent as described below and in relation to the drawings.

BRIEF DESCRIPTION OF THE DRAWINGS

Better understanding of the present invention will be had when reference is made to the accompanying drawings, wherein identical parts are identified with identical reference numerals, and wherein:

FIG. 5A is an end view of a second embodiment of the hinge of the present invention shown in the closed position; FIG. 5B is a door jamb side elevational view of the embodiment of the hinge of FIG. 5A shown in the closed position; FIG. 5C is a wall side elevational view of the embodiment of the hinge of FIG. 5A shown in the closed position;

FIG. 9A is an end view of the embodiment of the hinge of FIG. 7 shown in the closed position; FIG. 9B is a door jamb side elevational view of the embodiment of the hinge of FIG. 7 shown in the closed position; FIG. 9C is a wall side elevational view of the embodiment of the hinge of FIG. 7 shown in the closed position;

FIG. 10A is an end view of the embodiment of the hinge of FIG. 7 shown in the open position; FIG. 10B is a door jamb side elevational view of the embodiment of the hinge of FIG. 7 shown in the open position; and FIG. 10C is a wall side elevational view of the embodiment of the hinge of FIG. 7 shown in the closed position.

DETAILED DESCRIPTION OF THE DRAWINGS

Figure 1A:
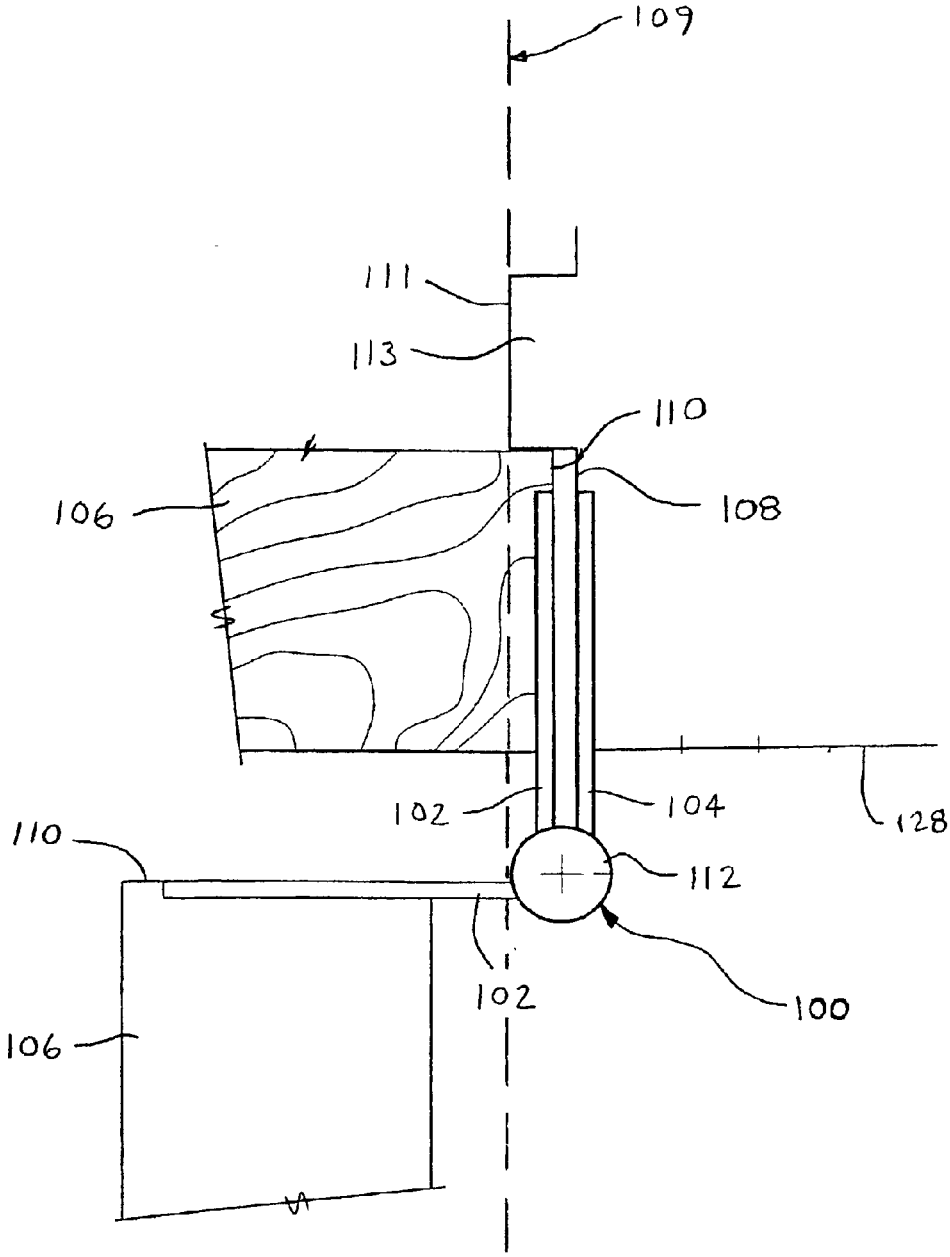
PRIOR ART FIG. 1A
FIG. 1A is an end view of a standard prior art butt hinge attached in mortise fashion to a door and a door jamb shown with the door closed and opened at 90 degrees.
Figure 1B:
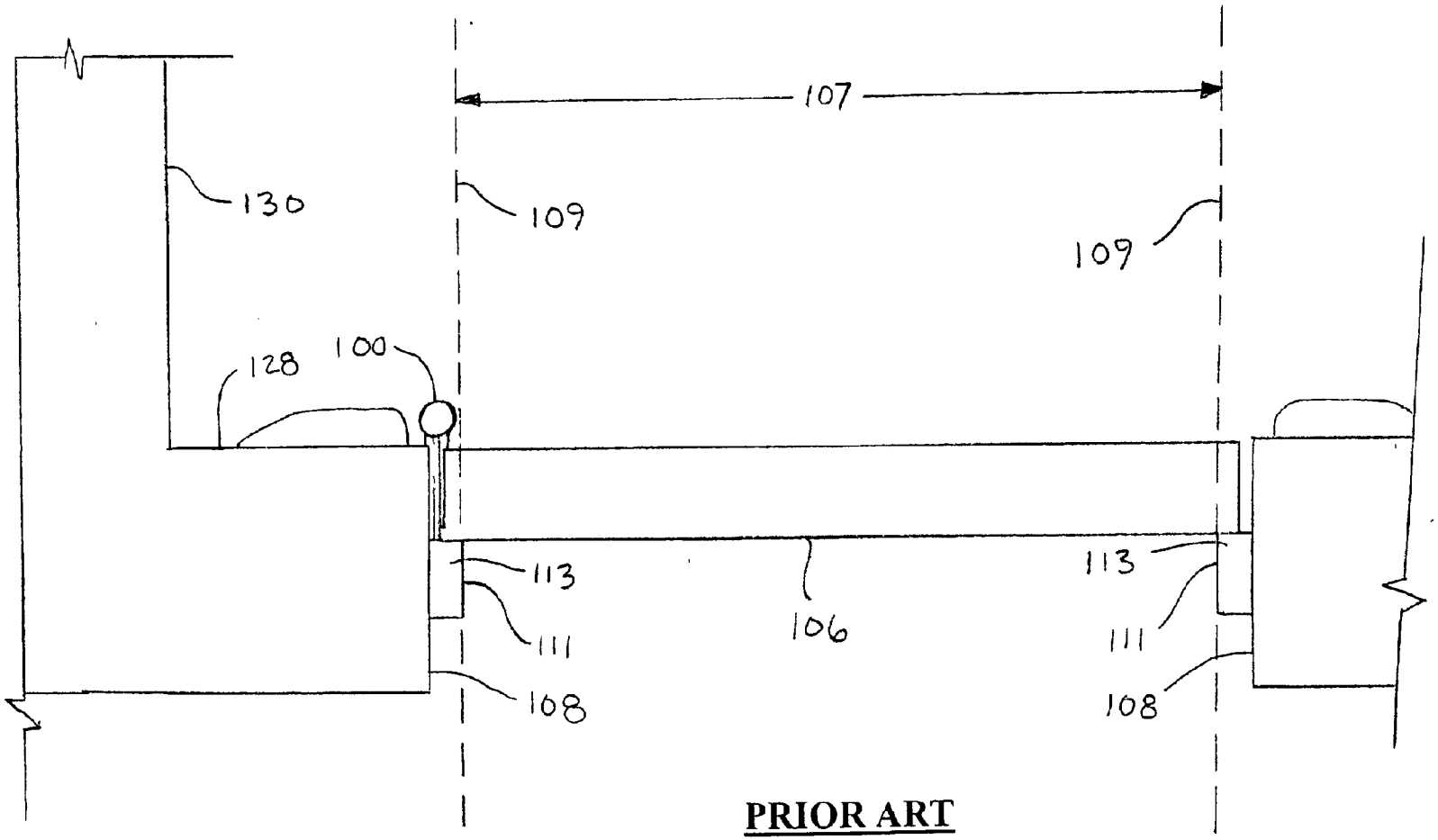
PRIOR ART FIG. 1B
FIG. 1B shows a standard prior art butt hinge attached in mortise fashion to a door and a door jamb with the door positioned in a doorway in a closed position.
Figure 2:
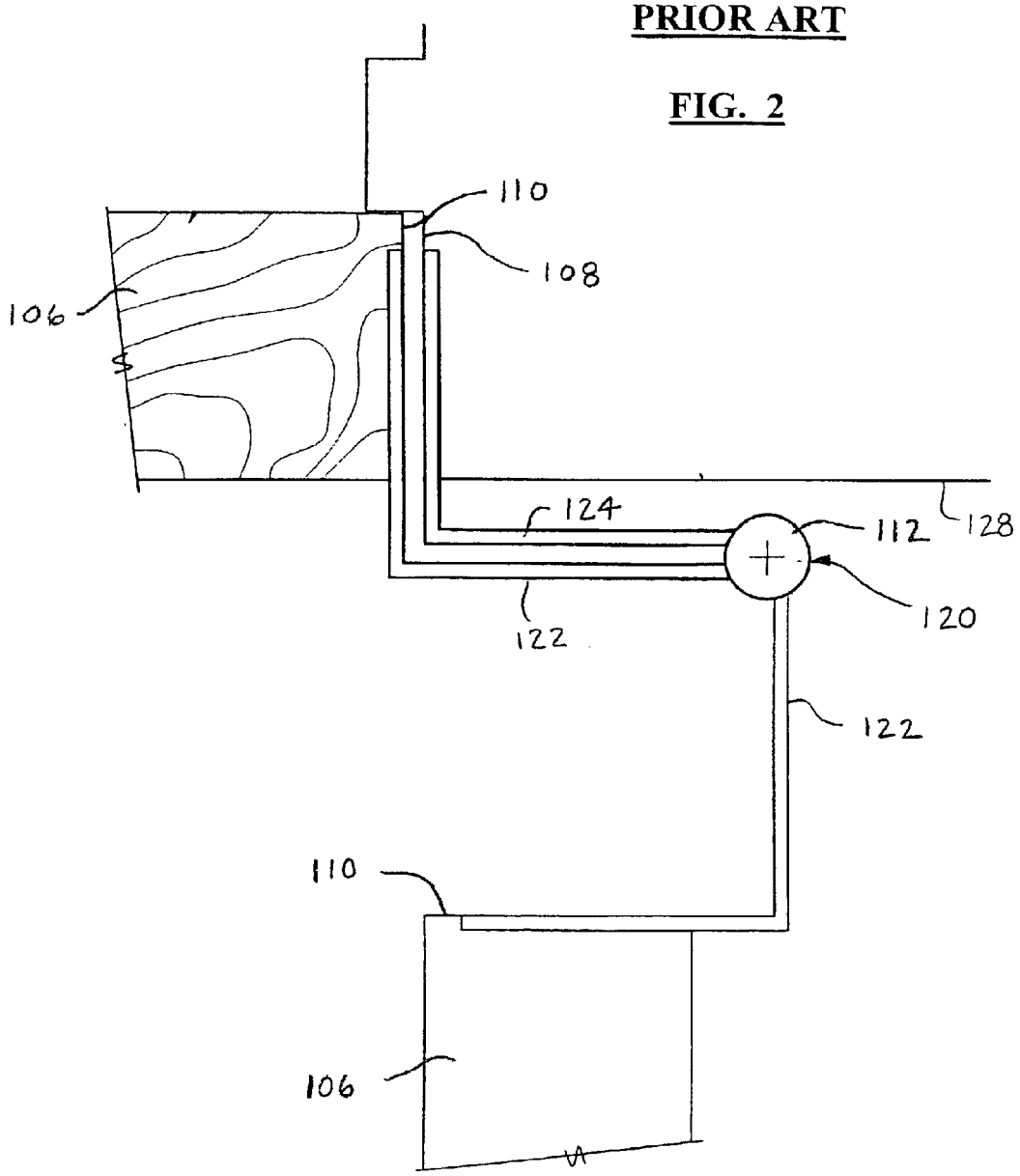
PRIOR ART FIG. 2
FIG. 2 is an end view of a prior art offset hinge attached in mortise fashion to a door and a door jamb shown with the door closed and with the door opened at 90 degrees.
Figure 3:
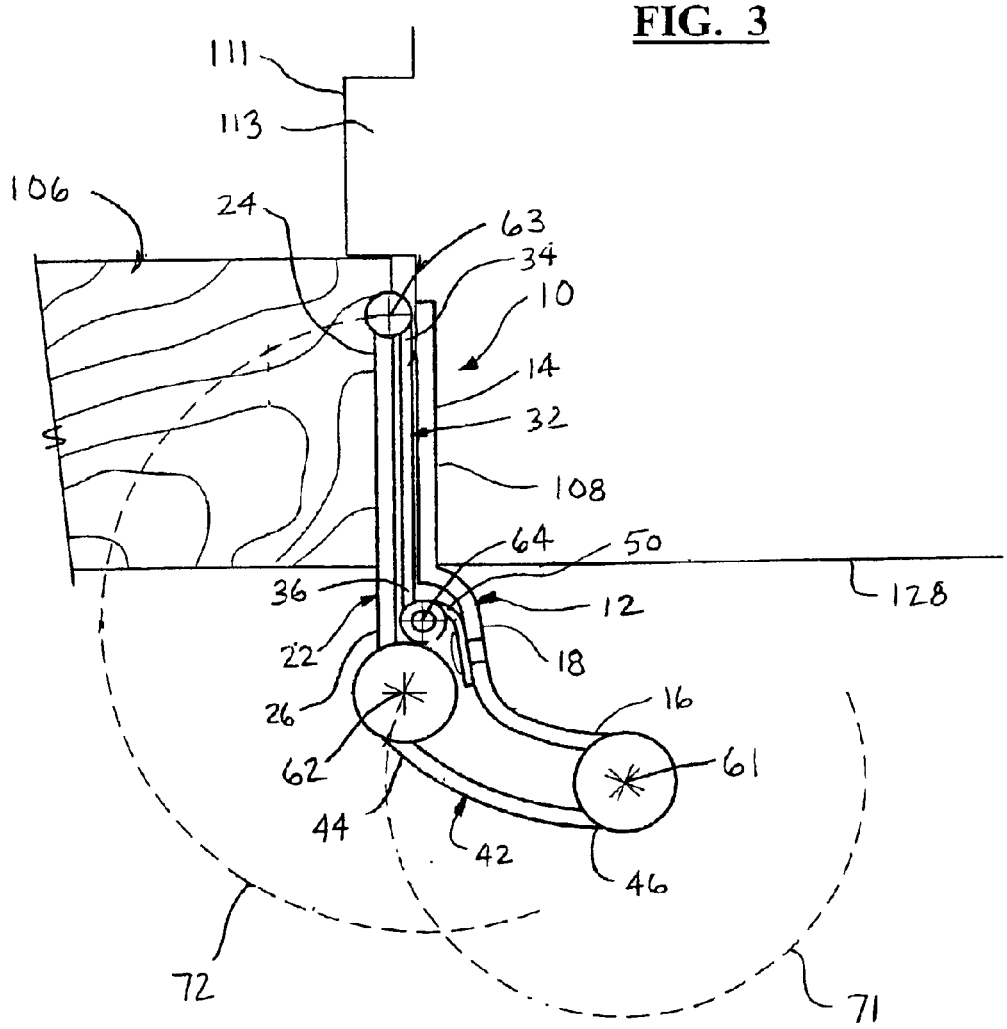
FIG. 3 is an end view of one embodiment the hinge of the present invention attached in mortise fashion to a door and a door jamb shown in the door closed position.
Figure 4:
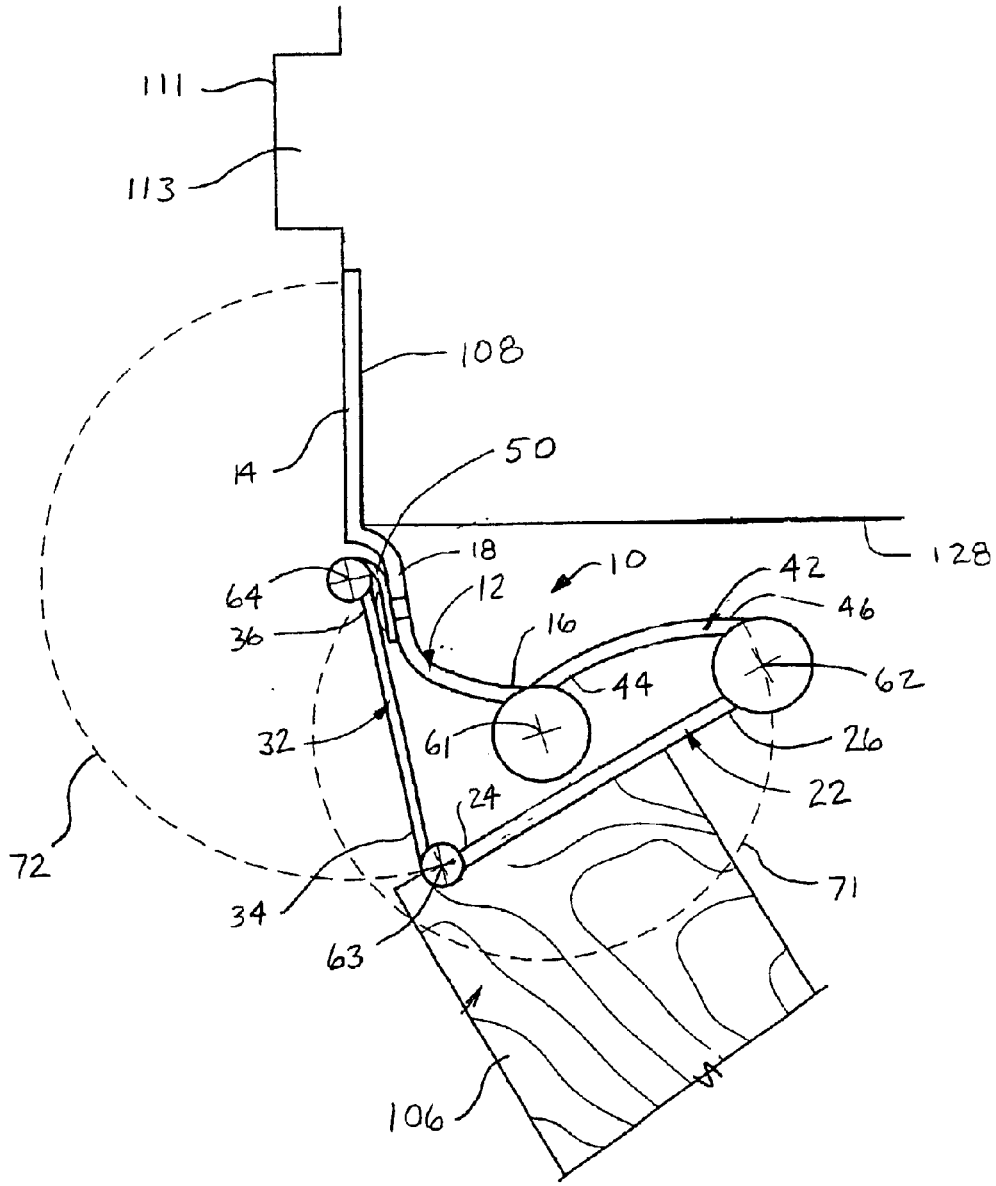
FIG. 4 is an end view of the embodiment of the hinge of FIG. 3 attached in mortise fashion to a door and a door jamb shown in the door open position.

Referring now to FIGS. 3 and 4, the hinge 10 of the present invention is shown attaching a door 106 to a door jamb 108 in a door closed position and a door open position, respectively. The hinge 10 comprises a first hinge member 12 comprising a first generally planar end portion 14 fixably attached to the door jamb 108, a second end portion 16, and an intermediate portion 18 between the first end portion 14 and the second end portion 16. The hinge 10 further comprises a second hinge member 22 fixably attached to the door 106, the second hinge member 22 having a first end 24 and a second end 26. Hinge 10 also comprises a means 32 for limiting the distance that the door 106 is able to open which may comprise a third hinge member 32 having a first end 34 hingedly attached to the first end 24 of the second hinge member 22 and a second end 36 hingedly attached to a knuckle portion 50 which is fixably attached to the intermediate portion 18 of the first hinge member 12. The hinge 10 also comprises a fourth hinge member 42 having a first end 44 hingedly attached the second end 16 of the first hinge member 12 and a second end 44 hingedly attached to the second end 26 of the second hinge member 22. The first hinge member 12 is configured such that the second end portion 16 and intermediate portion 18 are angled from the planar first end portion 14 away from the door 106 and away from wall 128 when the door 106 is in the closed position. The intermediate portion 18 is configured to provide an attachment for knuckle portion 50 and clearance for the third hinge member 32, clearance for the connection of the knuckle portion 50 to the third hinge member 32, as well as clearance for a casing (not shown) which may be attached to the wall 128. The second end portion 16 of the first hinge member 12 is positioned and configured to provide a point of rotation that in conjunction with the remainder of hinge 10, allows the door 106 to swing out of the doorway clearance space 109 when the door is opened 90 degrees.

FIGS. 3 and 4 show the range of motion of the hinge 10. The hinged attachments of the hinge members is generally accomplished by a hinge pin positioned through axially aligned knuckles to effectively couple the leaves about a common axis or pivot point defined by the hinge pin as best shown with respect to FIGS. 4A–5C. While referred to as pivot points below, it is recognized that the connections pivot about an axis. Referring again to FIGS. 3 and 4, the first hinge axis or pivot point 61 is formed by the attachment of the second end 16 of the first hinge member 12 to the second end 46 of the fourth hinge member 42. Pivot point 61 or hinge pin 61, is fixed in position. The second pivot point 62 is formed by the attachment of the first end 44 of the fourth hinge member 42 to the second end 26 of the second hinge member 22. Pivot point 62 or hinge pin 62, is able to rotate in an arc 71 about the fixed first pivot point 61. The third hinge pivot point 63 is formed by the attachment of the first end 24 of the second hinge member 22 to the first end 34 of the third hinge member 32. The fourth hinge pivot point 64 is formed by the attachment of the second end 36 of the third hinge member 32 to the knuckle portion 50 fixably attached to the intermediate portion 18 of the first hinge member 12. Pivot point 63 or hinge pin 63, is able to rotate in an arc 72 about a fourth pivot point 64 which is fixed in position.

In operation of the hinge 10, the door 106 is fixably attached to the second hinge member 22 which has first end 24 rotatable about pivot point 64 and second end 26 rotatable about pivot point 61. The kinematical relationship of the hinge members allows the door to be completely out of doorway clearance space 107 when the door 106 is opened about 90 degrees. In addition, the door 106 is generally 30% closer to the wall 128 than a comparable offset hinge 120.

The four pivot points 61–64 generally form a quadrilateral and provide increased strength to the hinge 10. In contrast, this provides a significant strength advantage over the single offset pivot point 112 of the offset hinge 120 which is positioned a much greater distance from the door 106. The single offset hinge point 112 must endure the entire weight of the door compounded by the moment effect of the distance of the door from the hinge point 112.

FIGS. 5A–5C provide different views of a second embodiment of the hinge 10' of the present invention. Referring now to FIG. 5A, hinge 10' comprises a fifth hinge member 52. The fifth hinge member 52 is provided to make the hinge 10' easier to manufacture from standard parts, however, the operation of the hinge is the same as hinge 10. With hinge 10', the second hinge member is a standard door side hinge 102 of a standard butt hinge 100. The third pivot point 63' is not directly attached to the second hinge member 102, however, it is still located in the same relative position as in hinge 10. The third pivot point 63' is formed by the attachment of a first end 54 of the fifth hinge member 52 to the first end 34 of the third hinge member 32. The movement of pivot point 63' is unchanged from the movement of pivot point 63 in hinge 10. The fifth hinge member 52 is fixably attached to the heel 110 of the door 106 directly underneath the second hinge member 102. Standard door hinge screws (not shown) are positioned through apertures 90 in the second hinge member 102 and the fifth hinge member 52 to secure the hinge 10' to the door 106. The fifth hinge member 52 may be made of a smaller gage material to enable the second hinge member 102 and the fifth hinge member 52 to fit in a standard door mortise. Minor machining may be required to make room for the thickness of the fifth hinge member. Similarly, the third hinge member 32 may be made of a smaller gage material to enable the third hinge member 32 to fit between the second hinge member 102 and the first hinge member 12.

As best shown in FIGS. 5A–6C, the hinge members 12, 32, 42, 52, and 102, each have one or more rolled, tubular segments or knuckles 80 along a side edge. The knuckles 80 of each hinge member 12, 32, 42, 52, and 102 are specifically sized and arranged so as to mesh in axial alignment with the knuckles 80 of an adjacent hinge member, thereby forming a hinge bone. Hinge pin 61, 62, 63, or 64 is inserted through the axially aligned knuckles 80 to effectively couple the hinge members 12, 32, 42, 52, and 102 so that they are movable relative to one another about a common axis, defined by the hinge pin 61, 62, 63, and 64.

It is noted that the knuckle sizes vary with the gage of material used for the hinge members 12, 22, 32, 42, 52, and 102. Knuckles 82 on the smaller gage hinge members 42, 52, and knuckle portion 50 are preferably made of a smaller gage material. The smaller gage material allows the use of smaller hinge pins 63, 64. The larger gage material results in larger knuckles 84 and allows the use of standard sized hinge pins 61, 62. As best shown in FIGS. 3 and 5, the smaller connections are preferable such that when the door is closed, the stacked hinge members 12, 22, 32, 42, 52, and 102 do not significantly increase the width of the hinge 10, 10' over that of a similarly sized standard butt hinge 110. This enables the standard door mortise to be used such that little or no additional machining is required. It is important that the distance between the door heel 110 and the door jamb 108 remains generally the same as with a standard butt hinge 120, especially when retro-fitting standard butt hinge 120 with the hinge of the present invention 10, 10'. This ensures that the strike side of the door 106 properly engages and that the door 106 operates properly.

Hinge member 22 of hinge 10 is generally made of a larger gage material than that of hinge member 32. The second end 26 of hinge member 22 has a large knuckle 84 and the first end 24 of hinge member 22 has a small knuckle 82. This typically requires that the hinge member 22 has a smaller gage at the first end 24 of the hinge member 22 than the gage of the remainder of the hinge member 22, so that the smaller knuckle 82 can be produced.

Figure 6B:
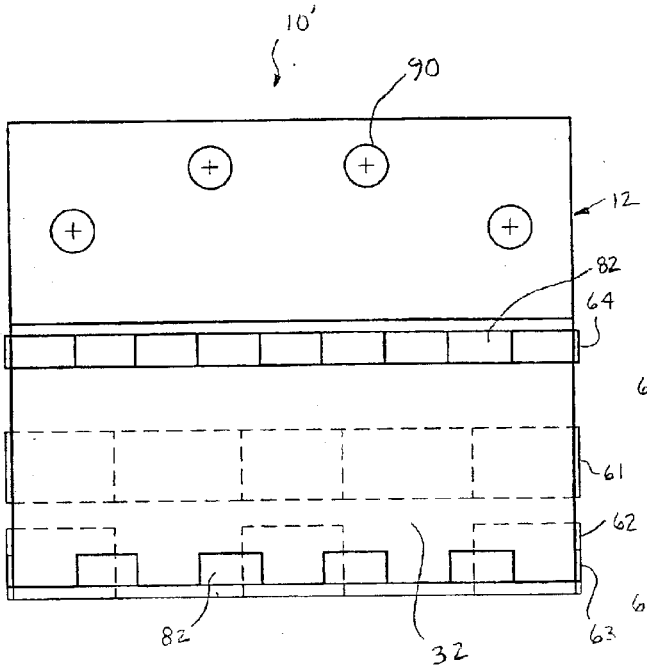
FIG. 6B is a door jamb side elevational view of the embodiment of the hinge of FIG. 5A shown in the open position.
Figure 6A:
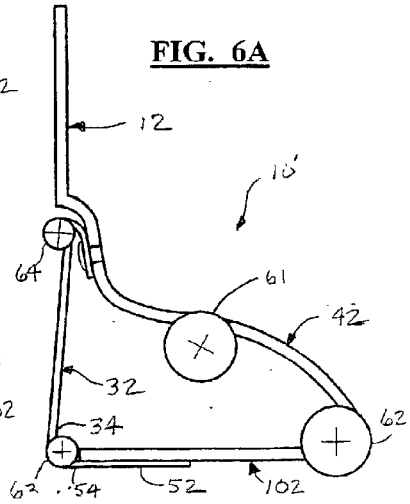
FIG. 6A is an end view of the embodiment of the hinge of FIG. 5A shown in the open position.
Figure 6C:
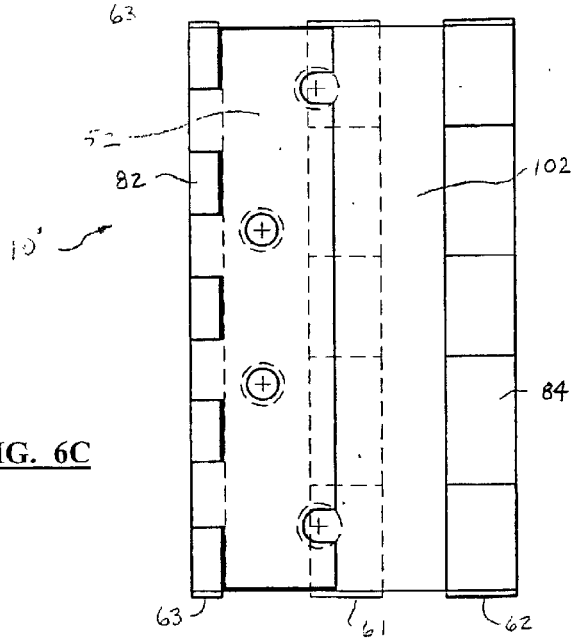
FIG. 6C is a wall side elevational view of the embodiment of the hinge of FIG. 5A shown in the closed position.

Hinge 10, 10' is aesthetically pleasing. When in the open door position, the fourth hinge member 42 conceals the interior of the interior portion of the hinge 10, 10' as shown in FIG. 6B and looks similar to a standard butt hinge 110 open at 180 degrees. In the door closed position, hinge 10, 10' has a minimized visible surface area referred to as the "footprint" as shown in FIG. 5C and the lower portion of FIG. 5B, which is much smaller that the large surface area footprint of the offset hinge 120. The curved surfaces of the fourth hinge member 42 and of portions of the first hinge member 12 also provide an enhanced look to the hinge 10, 10'.

It is noted that in hinge 10, 10', the hinge members 12, 22, 32, 42, 52, 102 are generally in the form of planar or curved rectangular plate similar to the leaves of the standard butt hinge 110. However, the hinge members of the present invention are not limited to the configuration shown. It may be desirable to reduce the footprint of the hinge even more by substituting different configurations for parts or all of one or more hinge members. Accordingly, an alternate embodiment showing one variation of the possible different configurations is presented below.

Figure 7:
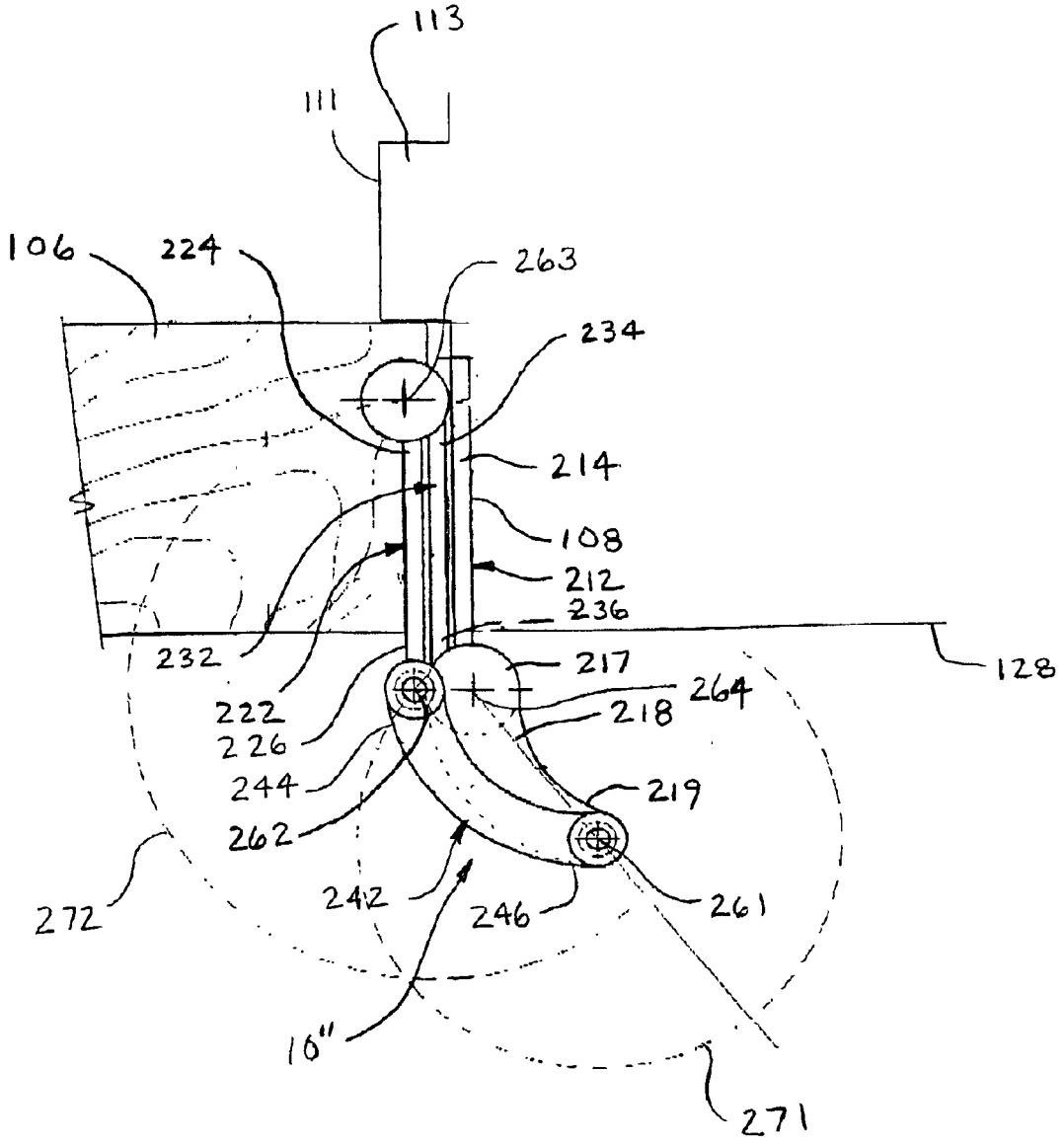
FIG. 7 is an end view of an alternate embodiment of the hinge of the present invention attached in mortise fashion to a door and a door jamb shown in the door closed position.
Figure 8:
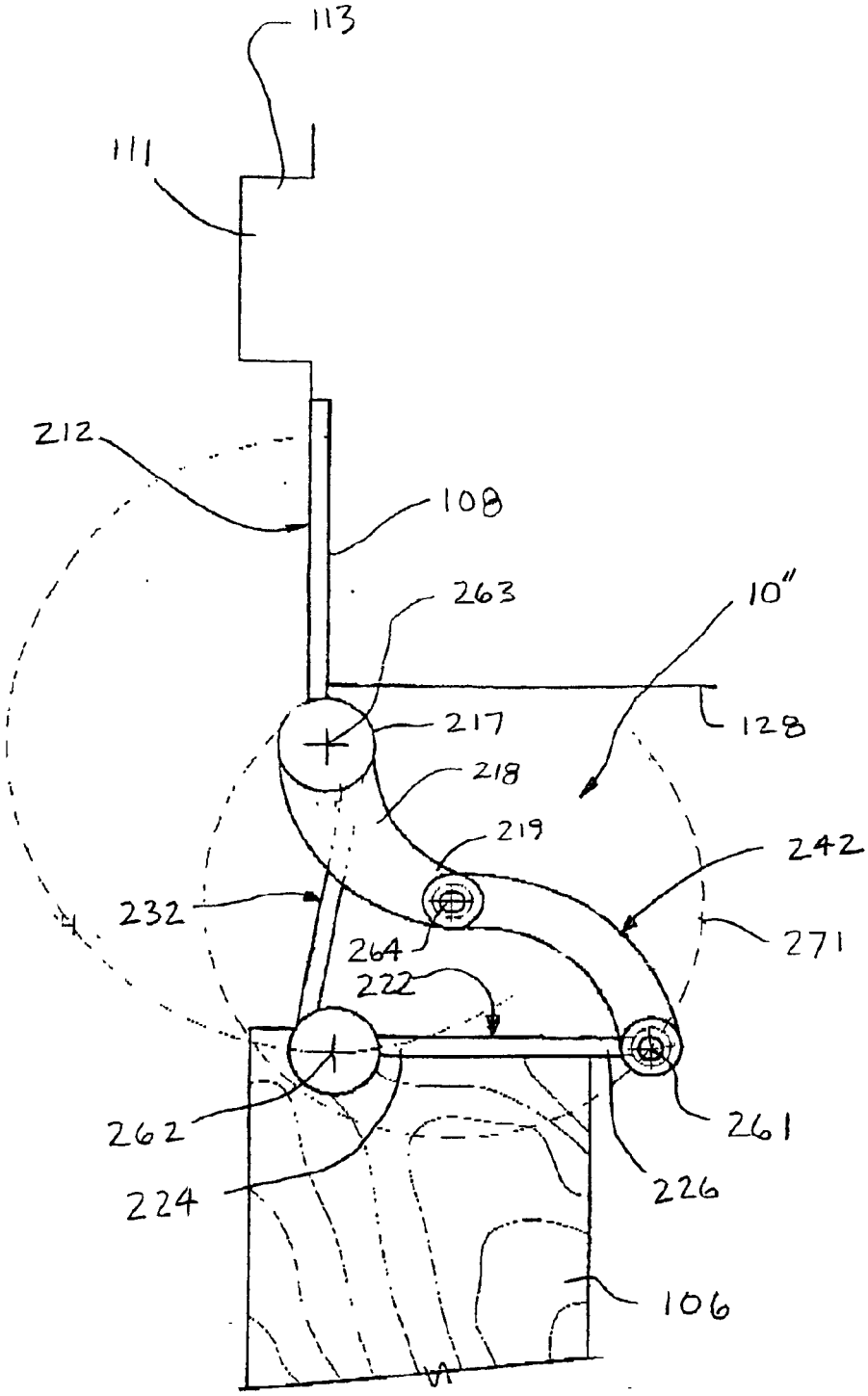
FIG. 8 is an end view of the embodiment of the hinge shown in FIG. 7 attached in mortise fashion to a door and a door jamb shown in the door open position.

An alternate embodiment of the present invention is shown in FIGS. 7–10C. Referring now to FIGS. 7 and 8, the alternate embodiment hinge 10" of the present invention is shown attaching a door 106 to a door jamb 108 in a door closed position and a door open position, respectively. The hinge 10" comprises a first hinge member 212. First hinge member 212 comprises a first part 214 comprising a generally planar portion 215 fixably attached to the door jamb 108, and a knuckle portion 216. First hinge member 212 comprises a second part 218 having a first end 217 coupled to the knuckle portion 216 of the first part 214 and extending to a second end 219 at an acute angle with wall 128. The hinge 10" further comprises a second hinge member 222 fixably attached to the door 106, the second hinge member 222 having a first end 224 and a second end 226. Hinge 10" also comprises a third hinge member 232 having a first end 234 hingedly attached to the first end 224 of the second hinge member 222 and a second end 236 hingedly attached to the knuckle portion 216 of the first part 216 of first hinge member 212. The hinge 210 also comprises a fourth hinge member 242 having a first end 244 hingedly attached the second end 219 of the second part 218 of first hinge member 212 and a second end 246 hingedly attached to the second end 226 of the second hinge member 222. Hinge 10" also comprises a fourth hinge member 242 hingedly attached to the first end 224 of the second hinge member 222 and a second end 246 hingedly attached to the knuckle portion 216 of the first part 216 of first hinge member 212.

Hinge 10" comprises a plurality of pivot points allowing movement of the door 106. The first pivot axis or pivot point 261 is formed by the attachment of the second end 219 of the second part 218 of the first hinge member 212 to the first end 244 of the fourth hinge member 242. Pivot point 261 is in a fixed position. The second pivot point 262 is formed by the attachment of the second end 246 of the fourth hinge member 242 to the second end 226 of the second hinge member 222. Pivot point 262 is able to rotate in an arc 271 about the fixed first pivot point 261. The third pivot point 263 is formed by the attachment of the first end 224 of the second hinge member 222 to the first end 234 of the third hinge member 232. The fourth pivot point 264 is formed by the attachment of the second end 236 of the third hinge member 232 to the knuckle portion 215 of the fist part 214 of the first hinge member 212. Pivot point 263 is able to rotate in an arc 272 about a fourth pivot point 264 which is in a fixed position.

As best shown in FIGS. 9A–10C, the hinge members 212, 222, and 232, each have one or more rolled, tubular segments or knuckles 84 along a side edge similar to that of hinge 10. The knuckles 84 of each hinge member 212, 222, and 232, are specifically sized and arranged so as to mesh in axial alignment with the knuckles 84 of an adjacent hinge member, thereby forming a hinge bone. Hinge pins (not shown) are inserted through the axially aligned knuckles 84 to effectively couple the hinge members 212, 222, 232 so that they are movable relative to one another about a common axis, defined by the pivot points 263 and 264.

In comparing hinge 10" with hinge 10, the position and movement of the hinge members is very similar when viewed from an end view. However, different views such as FIGS. 9A–10C reveal significant differences in the hinges 10, 10". The second part 218 of the first hinge member 212 and the fourth hinge member 242 are each formed as a plurality of links positioned above and below the hinge 10". Being positioned in different planes, the hinge members are able to slide over each other and not limit the movement of the hinge 10". Instead of being connected by hinge pins through a plurality of intermeshing knuckles, the second part 218 of the first hinge member 212 and the fourth hinge member 242 are pivotally attached at pivot point 261 by a pin attachment 267 and secured by end cap 268. The second end 246 of the fourth hinge member 242 is attached to the second end 226 of the second hinge member 222 at pivot point 262 by a pin attachment 269 and secured by end cap 268 as best shown in FIGS. 9B, 9C and 10C. It is noted that the pivot points 261 and 262 are not limited to the particular attachments shown herein. The second part 218 of the first hinge member 212 and the fourth hinge member 242 significantly reduces the footprint of hinge 10" in comparison with hinges 10, 10' as best shown in FIGS. 9A, 9C. Hinge 10" has reduced the footprint to virtually that of a standard butt hinge 110 having "outriggers" 218, 242 at either end to enable the door to swing away from the doorway.

The first hinge member 212 of hinge 10" is a hybrid in that the first part 214 is generally a standard hinge leaf or planar hinge plate having a knuckle at the end extending away from the door jamb. The second part 218 is a link member which is fixed in position with relation to the first part 214. The first and second parts 214, 218 of the first hinge member 212 have the same general connections and functions as the first hinge member 12 of hinge 10. The second part 218 is generally characterized as a part of the first hinge member 212, however, the second part 218 could also be characterized as a separate hinge member.

It is noted that the second part 218 of the first hinge member 212 and the fourth hinge member 242 are not limited to being positioned on the top and bottom of the hinge. It is contemplated that the second part 218 of the first hinge member 212 and the third hinge member 232 could be positioned on either the top of the hinge, the bottom of the hinge, or at any location in between.

It is also noted that in hinge 10", the third hinge member 232 is generally the same thickness as the first part 214 of the first hinge member 212 and the second hinge member 222. Any hinge strength lost by using links 218, 242 as compared to full plate leafs as in hinge 10 are more than compensated for by the stronger hinge member 232 and larger knuckles 84 used in connecting hinge member 232 to other members 212, 222. These differences may also significantly increase the width of the hinge 10" over that of a similarly sized standard butt hinge 110. This may require that the standard door mortise be modified to make room for the larger knuckle 84 and/or the thickness of hinge member 232.

Although the present invention has been described above in detail, the same is by way of illustration and example only and is not to be taken as a limitation on the present invention. While hinge 10' is presented as a second embodiment in relation to hinge 10, it is contemplated that similar slight modifications and changes can be made without departing from the scope of the present invention such as shown by the alternate embodiment 10". Accordingly, the scope and content of the present invention are to be defined only by the terms of the appended claims.

What is claimed is:

1. A hinge for attachment of a door to a jamb attachment face of a door jamb of a doorway, the doorway having a clearance space defined by the space between two parallel planes, each plane tangent to a corresponding front face of a door stop on either side of the doorway, the hinge comprising:

a first hinge member fixably attached to the door jamb;

a second hinge member fixably attached to the door;

a third hinge member having a first end hingedly attached to the first hinge member at a first hinge point and a second end hingedly attached to the second hinge member at a second hinge point;

wherein the second hinge point is rotatable about the first hinge point; and a means for controlling the position of the second hinge member with respect to the first hinge member;

wherein the third hinge member is generally parallel and adjacent to both the first hinge member and the second hinge member when the door is in a closed position;

wherein the door is positioned outside of the doorway clearance space when the door is opened 90 degrees and moveable to a position wherein the second hinge member is completely on the jamb side of the jamb attachment face.

2. The hinge of claim 1, wherein the means for controlling the position of the second hinge member with respect to the first hinge member comprises:

a fourth hinge member hingedly attached to the second hinge member at a third pivot point and hingedly attached to the first hinge member at a fourth pivot point.

3. The hinge of claim 2, wherein the third pivot point is rotatable about the fourth pivot point.

4. The hinge of claim 2, wherein the first hinge member is formed by two parts, wherein the first part of the first hinge member comprises a generally planar first end portion and a knuckle formed on a second end of the first part, and the second portion comprises a first end coupled to the knuckle of the first part and extending therefrom to a second end at the fourth pivot point.

5. The hinge of claim 4, wherein the first part of the first hinge member is generally formed at an obtuse angle with the second part of the first hinge member.

6. The hinge of claim 4, wherein the second part of the first hinge member and the fourth hinge member are positioned on a top end of the hinge.

7. The hinge of claim 4, wherein the second part of the first hinge member comprises a pair of second parts and the fourth hinge member comprises a pair of fourth hinge members wherein one second part and one fourth hinge member is positioned on a top end of the hinge and one second part and one fourth hinge member is positioned on a bottom end of the hinge.

8. The hinge of claim 1, wherein the second hinge point is positioned between the door and the door jamb when the door is in the closed position.

9. A hinge comprising:

a first hinge member having a first generally planar end portion having an attachment face side, an exposed side opposite the attachment base side, and a plurality of attachment holes, a second end portion, and an intermediate portion between the first end portion and the second end portion;

a second hinge member having a first end, a second end, and a plurality of attachment holes formed between the first end and the second end;

a third hinge member having a first end hingedly attached to the first end of the second hinge member and a second end hingedly attached to the intermediate portion of the first hinge member; and a fourth hinge member having a first end hingedly attached to the second end of the first hinge member and a second end hingedly attached to the second end of the second hinge member;

wherein the hinge is movable from a closed position wherein the second hinge member, the third hinge member, and the first end portion of the first hinge member are adjacent and generally parallel to each other to at least an open position wherein the second hinge member and the first end portion of the first hinge member are generally perpendicular to each other such that the second hinge member is generally positioned on the attachment side of the first end portion of the first hinge member.

10. The hinge of claim 9, wherein the hinge is configured to limit the rotation of the third hinge member to less than 220 degrees.

11. The hinge of claim 9, wherein the third hinge member is positioned between the first hinge member and the second hinge member when the hinge is in a closed position.

12. The hinge of claim 9, wherein the hinge attachment of the third hinge member to the first end of the second hinge member is made by a fifth hinge member positioned adjacent and parallel to the second hinge member.

13. The hinge of claim 9, wherein the intermediate portion and second end of the first hinge member are generally formed at an obtuse angle with the generally planar first end of the first hinge member.

14. The hinge of claim 9, wherein the intermediate portion of the first hinge member comprises at least one knuckle for hingedly attaching the second end of the third hinge member to the intermediate portion of the first hinge member.

15. The hinge of claim 9, wherein the third hinge member is made of a smaller gage material than the first and second hinge members.

16. The hinge of claim 9, wherein the first hinge member is formed in at least two parts wherein the first part of the first hinge member comprises the generally planar first end portion of the first hinge member and a knuckle of the intermediate portion of the first hinge member, and the second portion comprises a first end coupled to the knuckle of the first portion and extending therefrom to a second end corresponding to the second end of the first hinge member.

17. The hinge of claim 16, wherein the first part of the first hinge member is generally formed at an obtuse angle with the second part of the first hinge member.

18. The hinge of claim 16, wherein the second part of the first hinge member and the fourth hinge member are positioned on a top end of the hinge.

19. The hinge of claim 16, wherein the second part of the first hinge member comprises a pair of second parts and the fourth hinge member comprises a pair of fourth hinge members wherein one second part and one fourth hinge member is positioned on a top end of the hinge and one second part and one fourth hinge member is positioned on a bottom end of the hinge.

20. A hinge for attachment of a door to a jamb face of a door jamb of a doorway, the doorway having a clearance space defined by the space between two parallel planes, each plane co-planar with a corresponding front face of a door stop on either side of the doorway, the hinge comprising:

a first hinge member comprising a first generally planar end portion fixably attached to the door jamb; a second end portion, and an intermediate portion between the first end portion and the second end portion;

a second hinge member fixably attached to the door, the second hinge member having a first end and a second end;

a third hinge member having a first end hingedly attached to the first end of the second hinge member and a second end hingedly attached to a knuckle of the intermediate portion of the first hinge member; and a fourth hinge member having a first end hingedly attached to the second end of the second hinge member and a second end hingedly attached to the second end of the first hinge member;

wherein the third hinge member is generally parallel and adjacent to both the first generally planar end portion of the first hinge member and the second hinge member when the door is in a closed position;

wherein the door is positioned outside of the doorway clearance space when the door is opened 90 degrees and moveable to a position wherein the second hinge member is completely on the jamb side of the jamb attachment face.

21. The hinge of claim 20, wherein the hinge is configured to prevent the door from opening beyond a predetermined angle.

22. The hinge of claim 21, wherein the predetermined angle is about 140 degrees.

23. The hinge of claim 20, wherein the intermediate portion and second end of the first hinge member are generally formed at an obtuse angle with the generally planar first end of the first hinge member.

24. The hinge of claim 20, wherein the hinge attachment of the fourth hinge to the first end of the second hinge member is made by a fifth hinge member positioned adjacent and parallel to the second hinge member.

25. The hinge of claim 20, wherein the second, third, and fourth hinge members are each generally formed as plates having at least one knuckle formed on at least one end.

26. The hinge of claim 20, wherein the first hinge member is formed in at least two parts wherein the first part of the first hinge member comprises the generally planar first end portion of the first hinge member and a knuckle of the intermediate portion of the first hinge member, and the second portion comprises a first end coupled to the knuckle of the first portion and extending therefrom to a second end corresponding to the second end of the first hinge member.

27. The hinge of claim 26, wherein the first part of the first hinge member is generally formed at an obtuse angle with the second part of the first hinge member.

28. The hinge of claim 26, wherein the second part of the first hinge member and the fourth hinge member are positioned on a top end of the hinge.

29. The hinge of claim 26, wherein the second part of the first hinge member comprises a pair of second parts and the fourth hinge member comprises a pair of fourth hinge members wherein one second part and one fourth hinge member is positioned on a top end of the hinge and one second part and one fourth hinge member is positioned on a bottom end of the hinge.

30. A hinge comprising:

a first hinge member having a first generally planar end portion having a plurality of attachment holes, a second end portion, and an intermediate portion between the first end portion and the second end portion;

a second hinge member having a first end, a second end, and plurality of attachment holes formed between the first end and the second end;

a third hinge member having a first end hingedly attached to the first end of the second hinge member at a first hinge axis and a second end hingedly attached to the intermediate portion of the first hinge member at a second hinge axis; and a fourth hinge member having a first end hingedly attached to the second end of the first hinge member at a third hinge axis and a second end hingedly attached to the second end of the second hinge member at a fourth hinge axis;

wherein the third hinge member is generally parallel and adjacent to both the first generally planar end portion of the first hinge member and the second hinge member when the door is in a closed position;

wherein the first hinge axis rotates in a counter-clockwise direction about the second hinge axis and the fourth hinge axis rotates in a counter-clockwise direction about the third hinge axis when the door is moved from a closed position to an open position when installed as a right hinge and wherein the first hinge axis rotates in a clockwise direction about the second hinge axis and the fourth hinge axis rotates in a clockwise direction about the third hinge axis when the door is moved from a closed position to an open position when installed as a left hinge.

* * * * *